United States Patent [19]

Ortolani

[11] 3,997,391

[45] * Dec. 14, 1976

[54] MULTI-PRESS FOR THE DEHYDRATION OF SHEET PRODUCTS

[76] Inventor: Giuseppe Ortolani, Guarcino, Localita La Pezza, Milan, il 15 Giugno, Italy

[ * ] Notice: The portion of the term of this patent subsequent to July 1, 1990, has been disclaimed.

[22] Filed: July 28, 1971

[21] Appl. No.: 166,734

[30] Foreign Application Priority Data

Sept. 5, 1970 Italy ..... 29395/70

[52] U.S. Cl. ..... 162/360 R; 162/370

[51] Int. Cl.[2] ..... D21F 3/08; D21F 3/10

[58] Field of Search ..... 162/358, 368, 360, 370, 162/369, 364, 205, 360 R, 305; 100/93 RP

[56] References Cited

UNITED STATES PATENTS

| | | | |
|---|---|---|---|
| 480,770 | 8/1892 | Johnson | 162/368 X |
| 483,340 | 9/1892 | Benham | 162/368 |
| 581,731 | 5/1897 | Keeney | 162/368 |
| 2,672,078 | 3/1954 | Hornbostel | 162/360 |
| 3,265,559 | 8/1966 | Means | 162/358 |

FOREIGN PATENTS OR APPLICATIONS

| | | | |
|---|---|---|---|
| 697,774 | 9/1953 | United Kingdom | 162/360 |

*Primary Examiner*—S. Leon Bashore
*Assistant Examiner*—Richard V. Fisher
*Attorney, Agent, or Firm*—Young & Thompson

[57] ABSTRACT

A multi-press for removing water from sheet material such as paper, comprises a suction cylinder comprising a stationary internal cylinder and a rotatable external cylinder thereon that is permeable to the passage of fluid therethrough. The stationary internal cylinder is divided into a plurality of isolated sectors of equal volume that communicate with the rotatable cylinder through slots extending longitudinally of the stationary cylinder. Separate valves individually control the vacuum in each of the isolated sectors. Equally peripherally spaced pressing cylinders press superposed webs with wet sheet material between them, against the periphery of the rotatable cylinder. The pressing cylinders are disposed one adjacent each of the slots.

3 Claims, 5 Drawing Figures

SUCTION PUMPS

MULTI-PRESS FOR THE DEHYDRATION OF SHEET PRODUCTS

The present invention refers to a press with multiple elements for removing the maximum quantity of humidity from sheet or layer products having a soft consistency, for example, those used in the manufacture of paper or similar substances.

The present invention differs from the traditional systems now in use, and offers the following advantages:

a. greater dehydration, using the same number of dehydration couples and power, by means of a pressure-suction combination;

b. almost total exclusion of production interruption due to web rupture during the passage within the press units, thanks to the double support provided by the opposed felts between which the web is conveyed.

c. considerable reduction in size for this part of the plant in respect to traditional press units; the same results being obtained, the space required is reduced by at least 50%;

d. the use of a unique motor unit for more dehydrating couples, instead of a traditional type motor unit for each couple; this gives a considerable saving in the cost of the plant;

e. notable diminution in the working cost because of the reduction of the number of felts used, as well as the simplification of the plant parts — smaller number of motor units, reduction units, moving mechanical parts;

f. production increase, the interruption due to web breaking being excluded;

g. automation of the unit operation linearly, because of the continuous double support accompanying the web coming from the formation table to the dryer, without the intervention of personnel; and h. considerable increase of speed and therefore production, it being possible to keep the limitations due to the press unit down to practically nothing.

The multi press of the present invention, combines mechanical conventional action with pressure, and the action of extracting humidity by means of sectors under differentiated vacuum inside the permeable cylinder on which the pressure is exerted and open to the contact generatrix of each pressure couple.

The permeable cylinder through which liquid is extracted, is a driving cylinder and therefore it drags the free or idle press-cylinders in rotation. The axes of these free press-cylinders are parallel to the driving cylinder axis, while the pressure converges onto the same axes. The web transfer system comprises two felts or conveyor webs, which enclose between themselves the sheet to be dehydrated during the contact passage with the driving cylinder; according to need, felts may be made up of different permeable materials, animal or vegetable, synthetic or metallic fibres.

The cylinders exerting pressure are located near and are loaded by pneumatic-hydraulic means, regulated to obtain the necessary pressure.

In the detailed description which follows, there will be references to the accompanying drawing, wherein schematically illustrated and in transverse section there is a practical realization of the invention, with some variations.

Figures 1, 2, 3, 4, 5:
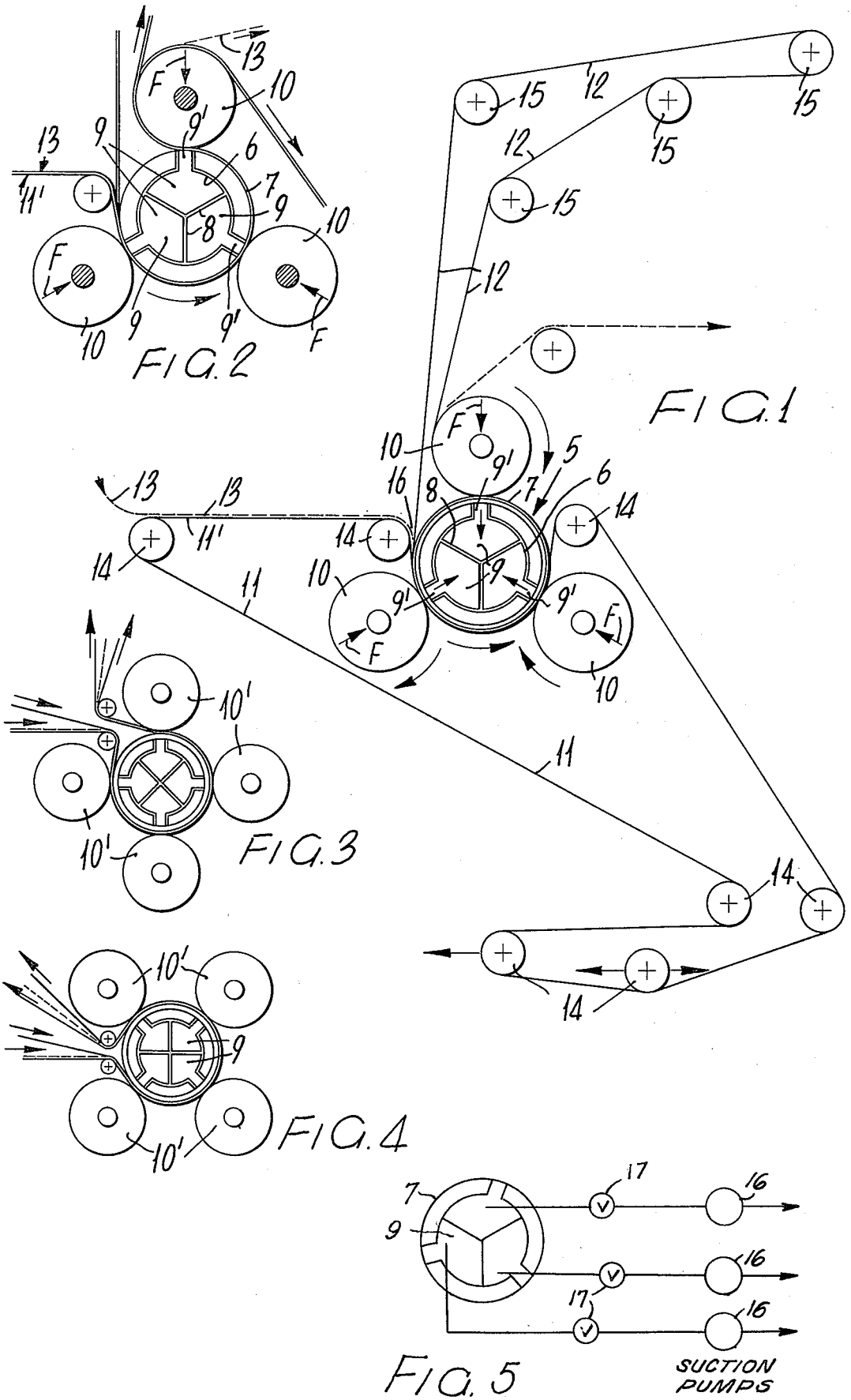
FIG. 1 shows in transverse section a press with three pressing cylinders.
FIG. 2 shows a variation in respect to FIG. 1, but again with three pressing cylinders.
FIGS. 3 and 4 show a press with four pressing cylinders in various positions.
FIG. 5 is a diagrammatic view of the suction control of the various sectors of the suction cylinder.

With particular reference to FIG. 1, the central cylinder 5 is made up of: the stationary internal cylinder 6, and the external cylinder 7 moved at one of its ends by means of any desired motor (not shown).

The internal cylinder 6 is hollow and the cavity separated by radial plates 8 in three isolated sectors 9 forming three conveying canals for the entire length of cylinder 6; each canal 9 presents a radial passage or longitudinal slot 9′ opening against the internal periphery of cylinder 7; the humidity is forced through 9′ by the pressure of the rollers 10 and through the permeable thickness of cylinder 7, it is sucked out through the respective canals 9. The pressing rollers 10 are free; each of them presses in direction F toward the axis of the central cylinder; said rollers 10 are preferably placed at equidistant intervals, and their entrant opening formed with the cylinder 7, is in line with the position of the passage 9′ in such a way that their entrant opening is displayed from their nip in a contrary sense to the direction of rotation of the cylinders, to absorb therefore, directly and constantly, the quantity of liquid that the pressure continues to accumulate immediately in advance of the nip.

Two web or felt conveyors 11 and 12 are stretched in a closed cycle on a series of guide rollers, respectively 14 and 15, and extend about a part of the periphery of cylinder 7 and press against cylinder 7 over all its periphery adjacent rollers 10.

The web 11, will be designated as "external" and the web 12 as "internal;" the pressing rollers 10 come into contact with conveyor 11; the second 12, remains in contact with the periphery of cylinder 7; from here, between them, the sheet 13 to be dehydrated, is introduced upward and before reaching the central cylinder, rests on a preferably flat run 11′ of the web 11; said sheet 13, enclosed between the two webs 11 and 12, then undergoes the pressure of the rollers 10 and has therefore a progressive liquid loss which is extracted continuously from the inside through passages 9′. The suction in general from suction pumps 16, and particularly, in relation to the sectors 9 with regard to their progression, is regulated through valves 17 which gradually regulate the output, as seen in FIG. 5.

The assembly of these regulating parts and the discharge ducts relative to each sector 9, suggest the usefulness of applying the transmission of the motion to cylinder 7 in the peripheral zone. The regulating parts and the transmission must be placed on one of the two ends of the cylinders 6–7 in order to leave the other end free for the operation of changing or substitution of the conveyor webs 11–12.

In regard then to the driving cylinder 7, the permeability is obtained by means of holes, which may be of various geometrical forms and devices preferred according to the type of work to be done.

In FIG. 2 a variation is shown, according to which the web 11 enwraps the driving cylinder 7 in such a manner as to enfold the sheet 13 under all of the cylinders; this solution may present greater safety in regard to the isolation of sheet 13.

FIGS. 3 and 4 show a solution with four rollers 10′ having four suction sectors 9; rollers 10′ may be placed cross-wise in relation to cylinder 5 (FIG. 3), or turned to 45° (FIG. 4); for the rest, the solution seen in FIG. 1 is satisfactory, the web 11 may enclose three or more pressure couples, consisting of cylinders 10.

The continuous conveyor webs 11 and 12 are naturally stretched on returning, deviation, traction or similar types of rollers, respectively 14 for web 11, and 15 for web 12, located according to the judgement of the constructor and therefore not shown in FIGS. 2, 3 and 4. All other parts known or easily obtainable by a good technician are not described or represented.

The operation of the press takes place in the following manner, for example following FIG. 1:

The three cylinders 10 are put into contact with the driving cylinder 7, loaded with a light pressure which gives rotation without sliding and therefore no irregularity in movement; the unit is then set in motion, and the vacuum generator is inserted; then, both with the conventional pneumatic-hydraulic system, and by means of a pick-up, the pilot slice of sheet 13, made of paper or some similar material, is fed to the suction cylinder 7 helping it to adhere to the conveyor felt (external) 11; automatically, the pilot slice is enclosed between external felt 11 and the internal felt 12, which meet at point 16 before undergoing the action of the first pressing cylinder 10. Always automatically, the slice continues under the action of the other cylinders 10 ending its course at the exit of the last cylinder 10, after which, by means of a pneumatic or other type of transfer, the slice is put into a dryer, continuing the run as in normal appliances.

With the slice moving forward, the web gradually enlarges until reaching normal work dimension, while every single pressing cylinder 10 is gradually loaded according to need, and the regular position and differentiated aspiration of sectors 9 are under vacuum regulation; the regulations being finally finished, the machine will proceed normally, and the sheet cannot be damaged by any rupture, even if foreign bodies (crumbs, clots, knots and others) get between the cylinder 7 and the internal felt 12, as it is protected and isolated by two felts 11 and 12 enclosing it between them.

Other than the variations foreseen in the present description and illustrated in the drawing, modifications and perfections may be added, both to improve the efficiency and to improve the results; such modifications and variations will obviously be within the protection of the present invention.

What we claim is:

1. A multi-press for the dehydration of sheet products, comprising a stationary internal suction cylinder, an external cylinder rotatable on and relative to said stationary cylinder and permeable to the passage of fluid therethrough, means dividing the interior of said stationary cylinder into a plurality of sectors that are isolated from each other, each of said sectors communicating with said rotatable cylinder through a slot that extends longitudinally of the stationary cylinder, said slots being equally peripherally spaced about said stationary cylinder, means for subjecting said sectors to suction, means for individually regulating the suction in each of said sectors, a plurality of pressing cylinders equal in number to said slots and equally spaced apart about and pressing radially inwardly upon said rotating cylinder, there being one said pressing cylinder adjacent each said slot, and a pair of endless felts that are superposed and pressed toward each other by and between said suction cylinder and pressing cylinders over a path which comprises at least an arc between two said pressing cylinders.

2. A multi-press as claimed in claim 1, there being at least three said pressing cylinders and said path comprising an arc that extends most of the way about the periphery of said suction cylinder.

3. A multi-press as claimed in claim 1, said pressing cylinders pressing toward said suction cylinder at points spaced a short distance from the associated said slots in the direction of rotation of said rotating cylinder.

* * * * *